United States Patent [19]

Rode et al.

[11] 4,100,036

[45] Jul. 11, 1978

[54] METHOD OF REGULATING CATHODE CURRENT DENSITY IN AN ELECTROPLATING PROCESS

[75] Inventors: Ernst-Dietrich Rode; Hans-Georg Winkler, both of Hamburg, Fed. Rep. of Germany

[73] Assignee: E.D. Rode KG, Hamburg, Fed. Rep. of Germany

[21] Appl. No.: 766,930

[22] Filed: Feb. 9, 1977

[30] Foreign Application Priority Data

Feb. 13, 1976 [DE] Fed. Rep. of Germany ..... 2605669

[51] Int. Cl.[2] ..... C25D 21/12

[52] U.S. Cl. ..... 204/14 R; 204/45 R; 204/228

[58] Field of Search ..... 204/228, 45 R, 14 R, 204/1 R

[56] References Cited

U.S. PATENT DOCUMENTS

| | | | |
|---|---|---|---|
| 3,536,881 | 10/1970 | Inoue | 204/228 X |
| 3,632,499 | 1/1972 | Chessin | 204/228 X |
| 3,887,452 | 6/1975 | Mannaka et al. | 204/228 X |

*Primary Examiner*—G. L. Kaplan

[57] ABSTRACT

The invention relates to a method and apparatus for the regulation of cathode current density in electroplating baths, so that optimum deposition characteristics are obtained. The apparatus includes at least one controllable power supply unit, by means of which the plating current or voltage can be adjusted in accordance with the optimum current density $J_O$, for the particular electroplating bath involved. The method includes the steps of measuring and adjusting the values of the plating current or voltage of the power supply unit in accordance with values determined from a graph F defined by the function $U = F(I)J_O$, having the optimum current density $J_O$ as a parameter. The function defines the interdependence between the plating voltage and the current, with the $J_O$ as a parameter.

The method facilitates the regulation of cathode current density to optimum deposition conditions, for electroplating articles having unknown and difficult to determine surface areas.

The apparatus includes also a master computer with a memory store for automatically adjusting and controlling the power supply unit.

8 Claims, 2 Drawing Figures

Fig. 1
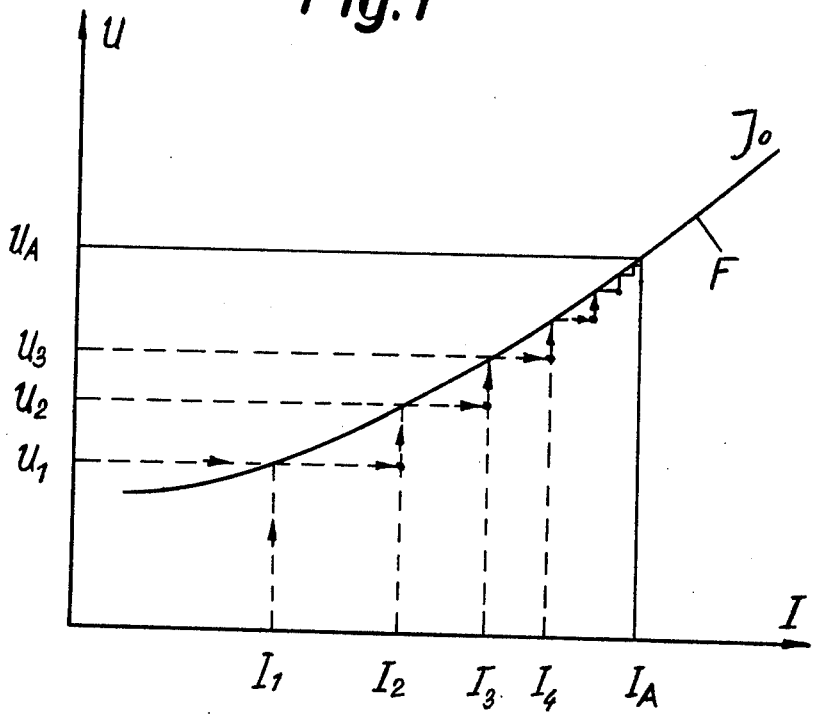
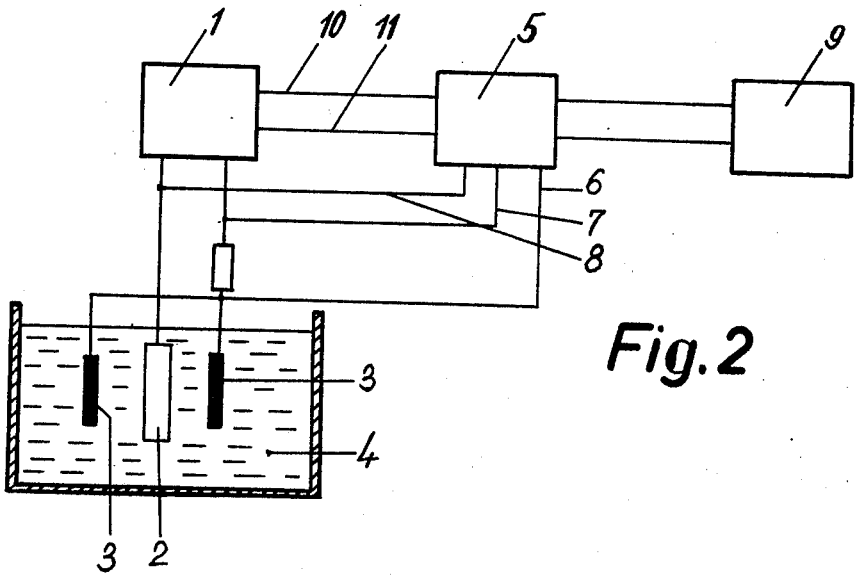
Fig. 2

METHOD OF REGULATING CATHODE CURRENT DENSITY IN AN ELECTROPLATING PROCESS

BACKGROUND OF THE INVENTION

The present invention relates to methods of and apparatus for regulating cathode current density in electroplating baths, in particular those of electro-plating installations having at least one controllable power-supply unit by means of which the plating current I or the plating voltage U can be adjusted, in accordance with the optimum current density $J_O$ for the particular electro-plating bath involved and the surface area A of the parts to be electroplated, to the value $U_A$ or $I_A$ which is necessary to produce $J_O$.

Electrolytes and electroplating baths for use in depositing metal on metallic articles are generally so constituted that they exhibit the optimum deposition characteristics only when the density of the cathode current lies within a specific range. If metal is deposited outside this specific range then the deposits which are made often have characteristics which differ considerably from those of deposits made when the current density is within the proper range. It is therefore desirable for the deposition of metal onto an article to be plated to take place at a specific current density. A specific current density is also a pre-requisite for achieving predetermined coating thicknesses since it is current density alone which determines the charge transfer which takes place per unit of time and per unit of area.

In principle it would be possible to determine current density by establishing the surface area of the part to be plated. Indeed, the procedure is employed either of measuring or determining surface area directly or else with certain parts of known configuration, of establishing surface area from weight. Using the figures for the surface area to be plated which are found, the requisite plating current can be calculated from the desired optimum current density and current can be regulated in the conventional way for substantially the whole of the period of deposition.

In the case of articles of complicated shape whose surface area is difficult to establish, such as are encountered when electro-plating printed-circuit boards or printed circuits for example, it is not practicable to proceed by establishing surface area. It is above all impracticable when fully automatic plating installations are supplied with articles to be plated of a varying nature. Another frequently employed method namely that of obtaining the actual figures for operation from the coating thickness found on a test batch, becomes unusable when, in particular, the number of items to be dealt with is small.

With fully automatic installations it is often the practice to use a constant voltage supply. For this the voltage is regulated to be constant at the feed points to the mounting for the rack for the parts to be plated. However, this method has the drawback that the electrical path between mounting for the rack and the region of cathode surface at which the metal deposition takes place is too long. This means that the deposition potential which is needed at the cathode vis a vis the electrolyte is by no means accurately reflected by what appears at the feed points.

Since the system voltage, i.e. the dropped voltage in the technical system, may be of the same order of magnitude as the deposition potential, then there is certainly nothing to be gained by using constant voltage to regulate current density when, in automatic installations, racks are loaded with different kinds of articles to be plated.

There are also processes known in which the deposition potential at the cathode is measured with the help of an auxiliary electrode by making a high-resistance measurement of potential. This method too is affected by system-dependant factors and is best suited to keeping known deposition conditions constant.

It is an object of the invention to provide a method by which, particularly in automatic electro-plating installations where the kinds of article to be plated vary and their surface area is unknown or largely unknown, the plating current or voltage can be so adjusted that a current density which is indicated as the optimum for the electrolyte in use can be achieved and maintained during the period of deposition. A further object is to provide apparatus suitable for putting the method into effect.

SUMMARY OF THE INVENTION

To this end, in a method of the kind described above, the invention provides the refinement that an auxiliary function F representing the interdependence between the plating voltage U and the plating current I, with $J_O$ as a parameter, is determined by calculation and/or measurement and, beginning from a freely selected initial value $U_1$ or $I_1$, the desired plating current $I_A$ or plating voltage $U_A$ is set in steps by an iterative process, by setting intermediate values of U or I determined from the function F, to at least an approximation which can be determined beforehand.

If it can be assumed that the function F, i.e. $U = F(I)_{JO}$, is a continuous function, the series $I_n$ will converge towards the value $I_A$. Accuracy will depend on, amongst other things, the number of setting steps.

In this way it is possible to approach as desired to the value $I_A$, and thus to the best current density $J_O$ for the process as indicated by the electrolyte, in a finite number of setting steps, thus ensuring that by the iterative adjustment operation $I_A$ can be arrived at and maintained with self-determining accuracy.

In a further refinement of the method the function F may be fed into a master computer which controls the power-supply unit, in the form of $U = f(I)_{JO}$ or $I = F^*(U)_{JO}$, so that the computer can by using the function F, repeatedly determine the requisite intermediate value from each previous value for U or I, and can set the power-supply unit to it until $U_A$ or $I_A$ is reached. In this way the stepwise adjustments to U or I can be made of a fixed number and/or of fixed values.

The apparatus for carrying out the method according to the invention is characterized in that to control the power-supply unit there is provided a master computer having a store into which the auxiliary function F is fed for storage, and in that the computer each time measures the plating current or plating voltage, compares it with desired values from the function F, and adjusts the power-supply unit stepwise to the desired values until $I_A$ or $U_A$ is reached.

BRIEF DESCRIPTION OF THE DRAWINGS

In order that the invention may be more clearly understood, reference will now be made to the accompanying drawings which show certain aspects thereof by way of example and in which:

FIG. 1 is a graph showing plating voltage U against associated plating current I to give a function F whose parameter is constant current density $J_O$, and FIG. 2 is a schematic view of an apparatus for putting the method according to the invention into effect.

DETAILED DESCRIPTION OF PREFERRED EMBODIMENT

In establishing the auxiliary function F it is first of all assumed that the intended electrolyte for the electroplating process exhibits its best deposition characteristics at a certain optimum current density $J_O$. In the practical instance now to be considered this current density will be 3A/dm$^2$ for example. Platable parts which have a specific, known surface area, are introduced into the electrolyte one after another. From the current density $J_O$ and the areas A of surface to be treated it is possible to calculate in advance the current intensities $I_a$ which are required to produce $J_O$ with particular areas A. Thus, when $J_O$ = 3A/dm$^2$ and the areas A area 1, 3, 5, 7 and 9 dm$^2$, the requisite current levels $I_A$ are 3, 9, 15, 21 and 27 Amps.

The current values are set on the power-supply unit in the same sequence as the parts having the various areas A are introduced into the electroplating bath so that the associated voltages $U_A$ which arise can be measured and finally plotted on a graph for example. The final result of this, after the individual measured points have been joined up, is the curve F shown in FIG. 1 whose parameter is $J_O$.

As an alternative to the method described above for establishing the function F, it is also possible for the function to be established from a single known point $I_A$ or $U_A$ by calculation or by matching with comparison curves.

The possibility also exists of establishing the function F during the actual electro-plating operation in the working bath itself or in a pilot bath operated in parallel therewith.

If it is planned to operate an electroplating installation with different electrolytes in different cases, then it obviously makes sense to establish the function F appropriate to the electrolytes, and the respective optimum current densities $J_O$, beforehand and to feed them into the store of the master computer as a family of functions.

In practice the method according to the invention may be carried out as follows. Since the articles to be electro-plated are ones whose surface area is unknown or at least largely unknown there is no possibility of at once setting the power-supply unit to the voltage $U_A$ or the current $I_A$ which would be required to arrive at the requisite current density $J_O$. However, it will already be known simply from experience that $U_A$ will certainly not be exceeded, i.e. that $U_1 < U_A$, if an initial voltage of $U_1$ is set on the power-supply unit. A suitably low voltage $U_1$ is therefore selected and set on the power-supply unit.

Since, under the conditions outlined above the actual area to be plated will be larger than the area for which $U_1$ would suffice to allow $J_O$ to be reached, a current $I_2$ will be set up. The relationship $I_2 > I_1$ applies in this case, $I_1$ being the current which, from the curve for F, should theoretically be associated with the selected voltage $U_1$.

The value of $I_2$ is measured and the associated voltage value $U_2$ is found from the curve for F and is set on the power-supply unit.

If it is the case that $U_2 < U_A$, then the current level $I_3$ which arises from $U_2$ will likewise lie below the curve for F. $I_3$ is measured in turn. When this is done it is found that $I_3$ is still not adequate to produce a current density of $J_O$ and a higher voltage $U_3$ is therefore set, in the manner described above, and this produces $I_4$. This series of adjustments is continued, as shown in FIG. 1, with the increments of voltage and current becoming smaller, until $I_A$, and thus the most favourable current density $J_O$, is arrived at with a sufficient degree of accuracy.

These operations, that is to say the measurement of the intermediate values $I_2$, $I_3$ etc. and the subsequent setting of the intermediate voltage values $U_2$, $U_3$ etc., are advantageously performed by the master computer which controls the power-supply unit, using as a basis the function F which has been fed into its store.

In the setting process described above the voltage and current steps become steadily smaller until $I_A$ and $U_A$ are reached and in principle the number of steps employed could be unlimited. However, it should be pointed out at this juncture that the adjusting operation is advantageously restricted to a fixed number of steps for which the computer has been programmed. The computer might also be programmed to re-set the power-supply unit by constant amounts in each instance for the intermediate values of U or I. It would also be possible for the sequence of measurement and adjustment steps to be fixed on a time basis.

In this case, occasions will occur when $U_2 > F(I_2)$. With this method, the process would have to be discontinued when the current level $I_{N+1}$ which would be set up is smaller than the current indicated for $U_N$ by the curve for F, so that $I_{N+1} < F(U_N)$. The relationship which then applies is $I_N < I_A < I_{N+1}$ and it is therefore possible with this method too, by a suitable procedure, to approach as closely as desired to the value $I_A$.

Some of the reasons for fixing the initial value of $U_1 < U_A$ at a relatively low level have already been explained. However, the intention is not to rule out the possibility of approaching the values $U_A$ and $I_A$ from higher voltages, when the relationship $U_1 > U_A$ would apply. However, this procedure is not so advantageous when an initial voltage $U_1$ higher than $U_A$ would have an unfavourable effect on the deposition process. Also for the same reasons, $U_1$ should not be fixed at a level excessively far below $U_A$.

It should also be mentioned that with the method described it is also possible to lay down constant currents as intermediate values, for example by setting $I_1 < I_A$ on the power-supply unit, measuring the resulting voltage $U_{2 < UA}$ and then setting the currents $I_2$ which function F indicates as belonging to $U_2$ and thus similarly approaching $U_A$, and thus the optimum current density $J_O$, in steps.

FIG. 2 is a simplified view of an electroplating apparatus which is suitable for carrying out the method described. It contains a power supply unit 1, to whose negative terminal the article 2 to be plated is connected, the article being situated in the electrolyte 4 together with the two anodes 3 connected to the positive terminals of the unit.

The power-supply unit 1 is controlled by a master computer 5 which measures the plating current via measuring leads 6, 7, and the associated plating voltage via leads 7, 8, and compares these values, in the manner already described, with the function F which has been fed into its store 9, so as to adjust the power-supply unit step by step via the control leads 10, 11 leading to it until $I_A$ or $U_A$ is finally reached.

The master computer 5 is advantaeously a process-control computer which ought also to be capable of controlling a plurality of measuring and adjusting operations on various operating levels, in which case it should also be possible for the computer to regulate a plurality of power-supply units. The process control computer may also perform tasks which are not simply connected with the control of the power-supply units. Inter alia, these may have to do with the control of the installation as a whole and with keeping a watch on the electrolytes.

We claim:

1. In a method of regulating cathode current density in electroplating baths having at least one controllable power supply unit by means of which the plating current I and the plating voltage U can be adjusted in accordance with the optimum current density $J_O$, for the particular electroplating bath involved, and the surface area A of the parts to be electroplated, when area A is unknown and difficult to determine, to the value $U_A$ or $I_A$ required to produce $J_O$, the method including the steps of:

selecting and introducing into the bath, several electroplatable parts which have various known and predetermined surface areas;

determining from the optimum current density $J_O$ and the surface area of each part, the plating current values required for producing $J_O$ for each part;

adjusting the power supply unit to the current values corresponding to each of the electroplatable parts; and measuring the associated voltages, which arise in response to the various currents;

the improvement which comprises the steps of:

introducing the electroplatable parts in a particular sequence into the bath;

adjusting the power supply unit to the plating current values, and measuring their associated voltages in the particular sequence that the electroplatable parts were introduced into the bath;

plotting a graph F representing the plating current values in the particular sequence versus the measured values of the associated voltages, the graph F being defined by a function $U = F(I)J_O$, and having as a parameter the optimum current density $J_O$;

introducing into the bath an electroplatable part, having an unknown surface area A;

freely selecting an initial value of voltage U, which is relatively low as compared with the optimum voltage $U_A$ on graph F;

adjusting the power supply unit to the voltage $U_1$;

determining from the graph F, the initial current I, associated with $U_1$;

measuring a current $I_2$, which is larger than the initial current I, but smaller than the optimum current $I_A$;

determining from the graph F, the value of the voltage $U_2$ associated with $I_2$;

adjusting the power supply unit to voltage $U_2$; and continuing to measure in sequence the intermediate currents arising in response to the adjustments of the power supply unit to the intermediate voltages determined from the graph F, with increments of current and voltage becoming relatively smaller and smaller until the values of the plating voltage and current closely approach the values of $U_A$ and $I_A$ required to produce $J_O$ for the electroplatable part.

2. A method according to claim 1, wherein an initial value of $I_1$ is freely selected, the current I, being relatively low as compared with the optimum current $I_A$ on the graph F, the power supply unit being adjusted to I, measuring the associated voltage $U_2$, the corresponding current $I_2$ being determined from the graph F, and wherein in a similar manner, sequentially measuring intermediate voltages and adjusting the power supply unit to the corresponding intermediate currents determined from graph F, until the values of plating current and voltage closely approach the values of $U_A$ and $I_A$.

3. A method according to claim 1, wherein the plating current values, the measured values of the associated voltages, the optimum current density $J_O$, as well as the function $U = F(I)J_O$ defining graph F, are fed into a master computer and stored in its memory, and wherein the master computer takes the intermediate current measurements in the particular sequence, compares with predetermined values, determines the intermediate voltages from graph F stored in its memory, and stepwisely adjusts and automatically controls the power supply unit in accordance with decreasing increments of plating current and voltage until the optimum current density $J_O$ is approached.

4. A method according to claim 3, wherein the master computer takes in the particular sequence measurements of intermediate voltages and determines the associated intermediate currents from the graph F stored in its memory.

5. A method according to claim 1, wherein the measurement and adjusting steps for the intermediate values of voltage and current are performed in a sequence that is selected on a time basis.

6. A method according to claim 1, wherein the values of current and voltage used in plotting the graph F are obtained in a pilot electroplating bath operated in parallel with the working electroplating bath itself.

7. A method according to claim 1, wherein various graphs F are plotted for different electroplating baths having different optimum current densities $J_O$.

8. A method according to claim 7, wherein the various graphs F are stored in the memory of a master computer to be used for automatic controlling and adjusting operations in different electroplating baths.

* * * * *